United States Patent [19]

Izzo

[11] Patent Number: 5,038,984

[45] Date of Patent: Aug. 13, 1991

[54] DUAL STRAP CARRYING SYSTEM FOR GOLF BAGS

[76] Inventor: Theodore-James Izzo, P.O. Box 1434, Evergreen, Colo. 80439

[21] Appl. No.: 460,406

[22] Filed: Jan. 3, 1990

[51] Int. Cl.[5] ..... A45F 3/04; A63B 55/00

[52] U.S. Cl. ..... 224/209; 224/202; 206/315.3; 206/315.5

[58] Field of Search ..... 224/209, 207, 259, 264, 224/210-216, 201-206; 206/315.1, 315.2, 315.3, 315.7, 315.4, 315.6, 315.8; 273/32 E

[56] References Cited

U.S. PATENT DOCUMENTS

| | | | |
|---|---|---|---|
| 1,809,120 | 6/1931 | Hall | 206/315.3 |
| 1,951,492 | 3/1934 | Schneider | 206/315.2 |
| 2,256,521 | 9/1941 | Kirkpatrick et al. | 206/315.3 |
| 2,533,440 | 12/1950 | Endee | 206/315.5 |
| 2,820,498 | 1/1958 | Endee | 206/315.5 |
| 2,853,111 | 9/1958 | Williams | 206/315.5 |
| 3,622,056 | 11/1971 | Droeger | 224/209 |
| 3,882,914 | 5/1975 | Strutz | 206/315.3 |
| 4,155,387 | 5/1979 | Costa | 206/315.6 |

*Primary Examiner*—Henry J. Recla
*Assistant Examiner*—David J. Walczak
*Attorney, Agent, or Firm*—John E. Reilly

[57] ABSTRACT

A golf bag has a support strap assembly that allows carriage by a person. The strap assembly includes a first strap having one strap end secured to the golf bag at a first location at its upper, open end, and the other strap end is secured to the golf bag at a second location longitudinally spaced from the first location. A second strap has one end secured to the golf bag at the second location, and the other strap end is secured to the golf bag at a third location longitudinally spaced from the second location between the second location and the closed end of the golf bag. The ends secured at the second location are preferably attached to one another to form a central portion for the strap assembly. The two straps thus allow the golf bag to be carried on both shoulders and oriented transversely across the back. Various mounts are described for these two straps, and different adjustment and padding structures are disclosed.

32 Claims, 4 Drawing Sheets

DUAL STRAP CARRYING SYSTEM FOR GOLF BAGS

FIELD OF INVENTION

The present invention relates to golf bags and, more particularly, to apparatus used in conjuction with golf bags to facilitate transport thereof by a person. Specifically, the present invention is directed to a dual strap golf bag carrying system whereby a person may carry a golf bag either with a pair of straps placed across both shoulders and with the golf bag resting against his/her back or with a single strap in the traditional manner.

BACKGROUND OF THE INVENTION

The game of golf is one of the most widely enjoyed sports activities in the world. The number of persons participating in this activity, both at the professional and recreational level, is almost unparalleled. Not only is this activity already widespread, but also the ranks of golfers continue to swell at an unprecedented rate.

The sport of golf is typically played on a course consisting of nine or eighteen holes. A set of clubs is used to strike a golf ball along the hole comprising the course. Each hole consists of a tee box which defines a starting location wherein a golfer places a ball and initially strikes the ball towards a green. Each green includes a recessed cup, and it is the object of the golfer to strike the ball with a series of strokes into the cup. Different clubs are used to vary the height, distance and spin of the ball. The holes normally vary in length from short holes of approximately one hundred yards to longer holes of five hundred yards and greater. The holes are flanked by rough areas out of which it is more difficult to play, and hazards are provided to increase the intricacy and precision required in play.

Golfers may travel over a course during play in a variety of manners. For example, a golfer may walk a course and carry his/her clubs or sometimes employs another to carry clubs for him/her. Other golfers employ wheeled pull carts which mountably receive a set of clubs so that a golfer may push or pull the cart as the golfer walks each hole. Motorized or engine driven carts are available at some courses and, in fact, are required for play at certain courses. Here, a golfer mounts his/her clubs on the motorized cart and drives across the course from ball lie to ball lie.

The present invention concerns those persons who walk a golf course and carry a set of clubs. This invention is thus useful for a substantial number of golfers who desire walking a golf course as a means of a healthy, enjoyable exercise. One of the drawbacks which has long existed for these golfers prior to the present invention, however, is the nature of the construction of the standard golf bag. Here, the typical golf bag which receives the set of clubs is in the form of a tubular carrying member enclosed at one end so that the shafts of the clubs may be longitudinally received in the bag. A single strap extends from an upper rim of the golf bag to a mid-point on the bag. The golfer or the caddy then carries such bag by inserting one arm through the strap so that the strap extends across one shoulder thus supporting the bag for travel. A small handle may also be mounted on the bag, normally between the end points of the strap, to enable the bag to be carried by the human hand.

A disadvantage to this system has long been present, though, and is readily realized by persons who carry golf bags over a golf course. This problem results from the fact that the entire weight of the golf clubs and bag, which may typically be on the order of twenty to twenty-eight pounds, tires the shoulder of the carrier. The weight of the bag unnecessarily strains the muscles of the neck and shoulder unduly and further causes muscular strain resulting from the imbalanced nature of this method of carriage. Indeed, the imbalance can cause associated muscle soreness in the hips and lower back due to the fact that the center of gravity of the bag is offset with respect to the spine. This is of particular concern to those golfers who experience back problems.

Despite the long felt need for a better carrying system for golf bags, there has been virtually no development of alternates to the above-described structure. There is such a need for carrying system that can be manufactured both by original equipment on a golf bag and which can be retro-fitted onto other golf bags of common manufacture. There is a further need for such a carriage system that is simple to use and enhances the game of golf for those who normally carry their golf bags.

SUMMARY OF THE INVENTION

It is an object of the present invention to provide a new and useful golf bag carrying system which may be employed by persons who carry golf bags during a round of golf.

Another object of the present invention is to provide an improved strap system for carrying golf bags which may be employed as a retro-fit system or may be manufactured in conjunction with the construction of a golf bag when it is originally produced.

A further object of the present invention is to provide a dual strap system to allow a golf bag to be carried in a centered manner on the back of a human carrier.

Yet another object of the present invention is to provide a dual strap golf bag carrying system so that the weight of a golf bag may be simultaneously supported by both shoulders of the golf bag carrier yet which may alternately be carried by a single strap on one shoulder, if desired, in the traditional manner.

A still further object of the present invention is to provide a dual strap carrying system for golf bags that is easy and convenient to use and is more comfortable for the carrier of a set of golf clubs.

According to the present invention, then, a golf bag carrying system is provided in the form of a dual strap carrier that may be either manufactured in conjunction with the construction of a golf bag, as original equipment, or which may be manufactured as a retro-fit system attachable to a standard golf bag assembly. To this end, in its broad form, the present invention is in the form of a strap assembly for use with a golf bag wherein the golf bag is in the form of an elongated tubular member having a surrounding sidewall, an enclosed end and an open end whereby the shafts of golf clubs may be inserted into the golf bag. The strap assembly includes a first strap having a first strap end secured to the golf bag at a first location proximate the open end and having a first strap second end secured to the golf bag at a second location longitudinally spaced from the first location along an attachment axis. The first strap thereby defines a primary strap forming a first strap opening which may be secured over one of the persons shoulders. The second strap has a second strap first end secured to the golf bag proximate the second location and has a second strap second end secured to the golf bag at a third location. longitudinally spaced from the second location along the attachment axis between the second location and the closed end of the golf bag thereby defining a second strap opening. The second strap thus forms a secondary strap which may be positioned over the other shoulder of the person so that the golf bag may be suspended from and supported by both shoulders in a fully supported state. In the fully supported state, therefore, the golf bag is oriented transversely across the back of the user.

Preferably, the first strap second end and second strap first end are fastened together to form a central portion which is secured to the golf bag at the second location. Preferably, the ends of the first and second straps proximate the central portion include resilient strap elements which help elevate the second strap when the golf bag is supported by the first strap thus facilitating insertion of a person second arm and shoulder through the second strap opening. Further, these respective strap ends, whether with or without the resilient elements, may be structured as a unitary strip extending around a central mounting element. This central mounting element may further be connected to a releasably mounting structure on the central portion for securing the central portion of the strap assembly to the golf bag.

This strap assembly is especially useful wherein the golf bag has a handle portion located on the sidewall and extending longitudinally between the first and third locations. The strap assembly can include a mounting web and buckle so that a free end of the mounting web can wrap around the handle to attach the central portion thereto. Thus, the handle defines the second location for attachment of the strap assembly to the golf bag. The first strap first end may include a first releasable mounting means, such as a swivel clip, and the second strap second end may include second releasable mounting means such as a second mounting clip, so that the ends of the strap assembly opposite the central portion may be releasably attachable to the golf bag respectively at the first and third locations. Further, the first and second straps may include adjustment elements for adjusting their respective effective lengths, and the first and second straps may be provided with pads operative as cushions on the persons shoulders. To this end, also, the golf bag may be provided with a pillow element circumferentially offset from the attachment axis approximately ninety degrees to rest against the back of the person when the golf bag is in a fully supported state with both of the first and second straps extending across respective shoulders of the golf bag carrier. Auxillary compartments may be provided on the exterior of the golf bag to carry auxillary golf equipment. In addition, a wedge-shaped structure may be mounted at the upper end of the golf bag to help prevent dislodgment of the golf clubs from the golf bag when it is carried.

The strap assembly described above may be employed with existing golf bags having a top mounting element, a handle and a bottom mounting element wherein the top and bottom mounting elements traditionally secure a unitary carrying strap for such traditional golf bags. However, this strap assembly may also be implemented with a specially constructed golf bag wherein a different structure is utilized for the upper and lower mounts. For example, in the exemplary embodiment of the present invention, a first mount located proximate the open end of the bag is in the form of a first mounting strip extending circumferentially around at least a portion of the tubular body on either side of the attachment axis and a first slide ring slideably received on this first mounting strip so that the mounting ring is movable along the first mounting strip to locations circumferentially on either side of the attachment axis. The bottom mount, at the third location, may include a second mounting strip extending circumferentially around at least a portion of the tubular body on either side of the attachment axis and a second slide ring slideably received on the second mounting strip so that it is movable to locations circumferentially on either side of the attachment axis. This second mounting strip may be movable longitudinally of the tubular body to adjust for different shoulder widths and may extend completely around the tubular body to cradle the tubular body when the golf bag is fully supported. By forming this central mount, at the second location, as a handle element, the position of mounting of the central portion to the golf bag may be selectably adjusted therealong. If desired, a linking cord may extend between the central portion of the strap assembly and the second strap free end, secured at the third location, so that, when the carrier desires to carry the golf bag solely by the first strap, carrying forces are transferred from the central portion to the third location.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention is directed to a golf bag assembly that uses a new and useful strap assembly enabling a golfer or other person to conveniently carry a golf bag on both shoulders although the structure described allows carriage of the golf bag on a single shoulder as well. In the broad form, the present invention is described either as a strapping assembly that may be manufactured as original equipment on a golf bag or which may be manufactured separately as a retro-fit attachment to existing golf bags. In either case, the invention, when used in conjuction with the golf bag, broadly includes a pair of straps which are connected to and oriented longitudinally along a golf bag to define an attachment axis. A first strap has a first strap first end connected to an upper portion of the golf bag and a first strap second end connected to a mid-portion of the golf bag that is longitudinally spaced from the upper portion. The second strap has a second strap first end that is connected to the mid-portion of the golf bag at or proximate to the location of the attachment point of the first strap second end. The second strap has a second strap second end that is connected to a lower portion of the golf bag longitudinally spaced from the mid-portion. These straps may then be mounted respectively over the left and right shoulders of a person who is to carrying the golf bag so that the weight of the golf bag is suspended from both of the persons shoulders to hang in an orientation across the person's back.

Figure 1:
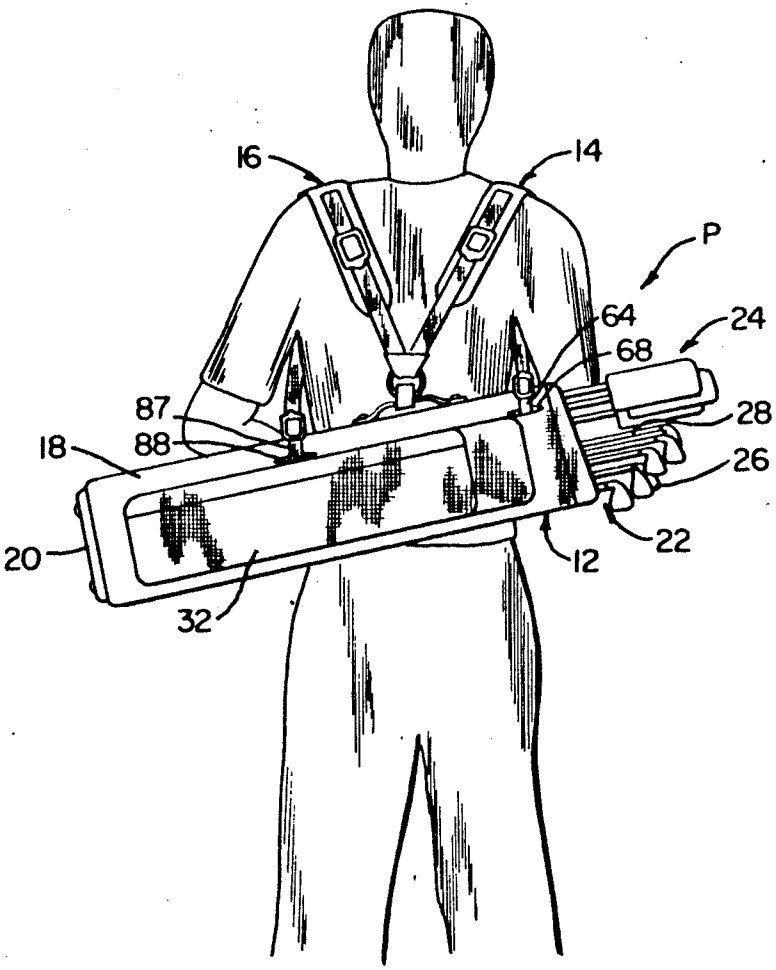
FIG. 1 is a perspective rear view of a person carrying a golf bag utilizing the present invention with the golf bag shown in a fully supported state for a right hand orientation.

The exemplary embodiments of this invention may best be seen with respect to the figures. In FIG. 1, for illustration purposes, it is seen that a person carries a golf bag 12 according to the present invention in a fully supported state by a first strap 14 and a second strap 16. Golf bag 12 is in the form of an elongated tubular body having a surrounding sidewall 18, a closed end 20 and an open end 22 so that a set of golf clubs 24 may be inserted in golf bag 12 for storage and transport. To this end, each golf club of the set of clubs 24 includes a head, such as head 26 and a shaft, such as shaft 28. Auxillary compartments 30 and 32 are provided to permit transport of auxillary golf equipment and, as noted below, are oriented to permit balancing of the weight of the golf bag and clubs.

Figure 2:
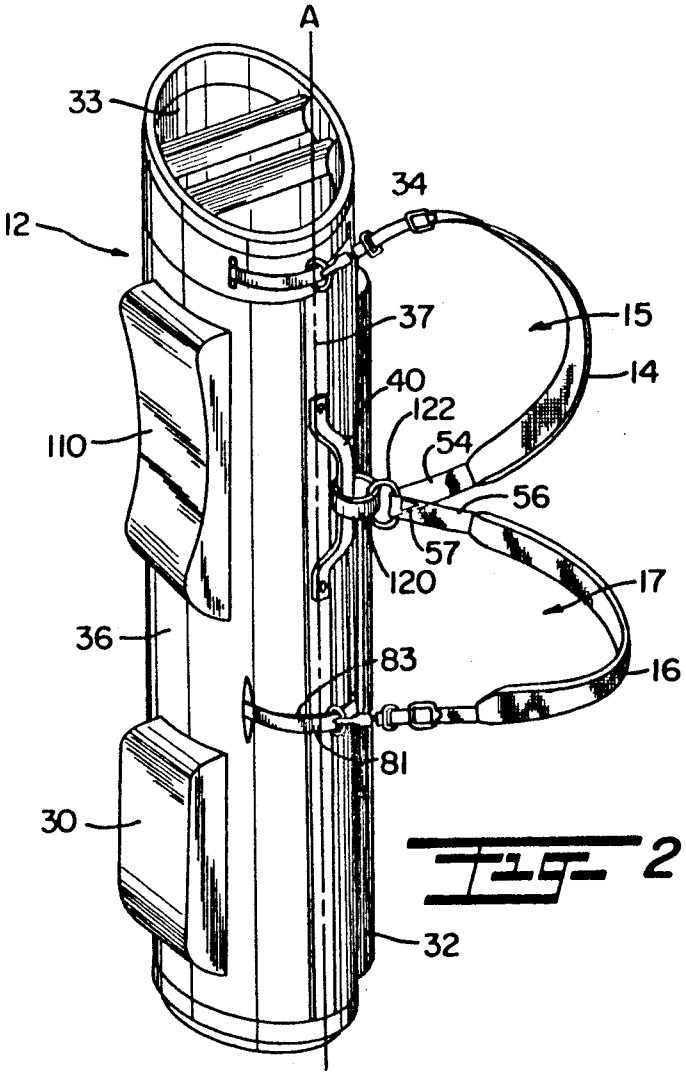
FIG. 2 is a perspective view of a golf bag assembly according to the present invention with a back pad secured thereto.

The golf bag structure implementing the present invention is shown in greater detail in FIGS. 2–6. In these figures, it may be seen that golf bag 12 has a central handle 40 located at a mid-portion of golf bag 12. First strap 14 defines a primary strap and has a first strap first end 52 which is secured to golf bag 12 at a first location along an upper end portion 34 adjacent open end 22. A second end 54 of first strap 14 is secured to golf bag 12 at a second location along a mid-portion thereof, and, to this end, second end 54 is secured to handle 40 as more thoroughly described below. Second strap 16 has a first end 56 secured to a mid-portion of golf bag 12, specifically to handle 40, and second strap 16 has a second end 58 secured to golf bag 12 at a third location longitudinally spaced from the point of attachment of ends 54 and 56 toward a lower portion of golf bag 12. Thus, as shown in FIG. 2, the first, second and third locations define a longitudinal attachment axis A. A wedge-shaped structure 33 is mounted in open end 22 diametrically opposite axis A and operates to help prevent inadvertent dislodgment of the golf clubs from golf bag 12 during use.

Figure 3:
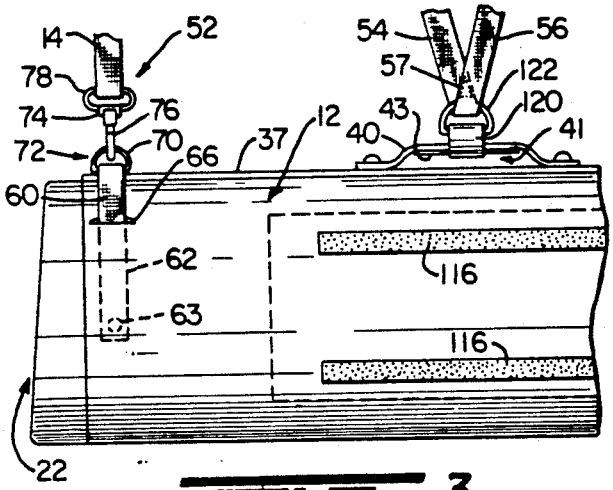
FIG. 3 is a side view in elevation showing the top portion of the golf bag of FIG. 2 with the back pad removed.
Figure 4:
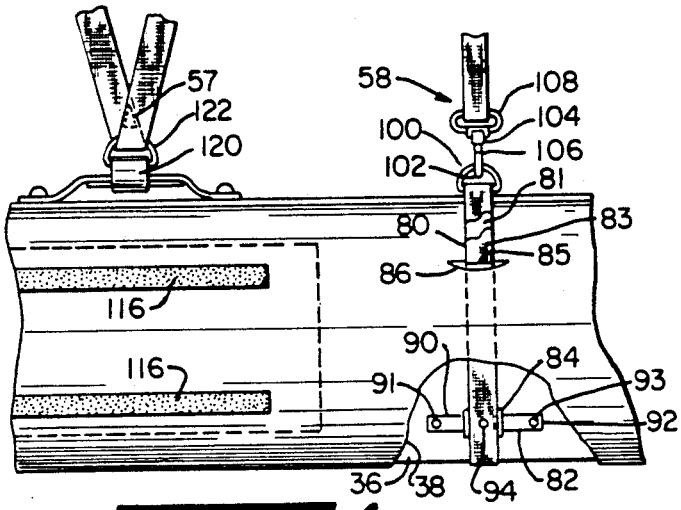
FIG. 4 is a side view in elevation and partially broken away of a mid-portion of the golf bag shown in FIG. 2 with the back pad removed.

As may be seen with greater particularity with reference to FIGS. 2–4, golf bag 12 may include a cylindrical shell 36, which is typically a plastic tube joined at a spine 37. Shell 36 is covered by a covering 38 of cloth, vinyl and the like. A first circumferential mounting strap 60 has end portions 62 and 64 secured at opposite diametric locations on upper end portion 34 of golf bag 12. As is shown in phantom in FIG. 3, this may be to shell 36 by means of a rivet 63 or other convenient form of attachment. Accordingly, end portions 62 and 64 of strap 60 extends through slits 66 and 68, respectively, in covering 38, so that they may be secured to cylindrical shell 36. Alternately, mounting strap 60 could extend completely around shell 36 to cradle golf bag 12.

As is best shown in FIG. 3, first strap 14 is mounted to golf bag 12 by means of a mounting ring 70 which is slideably mounted on strap 60 and can move circumferentially on either side of attachment axis A. To this end, strap 60 is received through opening 72 in mounting ring 70. Clasp 74 is a swivel clip having a clip head 76 that may be releasably fastened onto mounting ring 70 and, at the opposite end from head 76, includes a ring 78 to which a webbing strip is secured, as discussed below.

Turning to FIG. 4, it may be seen that the second end 58 of second strap 16 is mounted to golf bag 12 by means of a second circumferential mounting strap 80 which extends completely around to cradle golf bag 12. Strap 80 passes through slits 86 and 88 in covering 38 on opposite sides of golf bag 12, as is shown in FIGS. 1 and 4, with slits 86 and 88 being each offset approximately thirty degrees circumferentially of attachment axis A. Strap 80 preferably includes two strap sections 81 and 83 secured together at ends 85 and 87, respectively, and strap 80 is mounted for limited longitudinally sliding movement by means of a longitudinal band 82 which has opposite ends 90 and 92 riveted to cylindrical shell 36 by means of rivets 91 and 93, respectively. A slide bracket 84 is slideably mounted on band 82 for longitudinal sliding movement between rivets 91 and 93, and mounting strap 80 is attached to slide bracket 84 by means of a rivet 94. A mounting ring 100 has an opening 102 that receives mounting strap 80 so that mounting ring 100 may slide circumferentially between strap sections 81 and 83 and between circumferential limits defined by attached ends 85 and 87. A swivel clip 104 includes a clip head 106 that may be releasably fastened onto mounting ring 102 and a ring 108 is located oppositely to clip head 106 to receive a webbing strip again as discussed below.

Second end 54 of first strap 14 and first end 56 of second strap 16 are each secured at a location that is longitudinally spaced between mounting straps 60 and 80. In the preferred embodiment, these ends are attached together to form a central portion 55 of the strap assembly, and connection to the golf bag 12 is accomplished to handle 40 by means of a single releasable mounting strap assembly 120 described below in greater detail. To this end, however, mounting strap assembly 120 includes a large D-ring 122 and, as may be seen in the embodiment of FIGS. 2 to 4, ends 54 and 56 are secured to one another and around D-ring 122 by means of stitching 57.

It may be seen from the foregoing that first strap 14 is secured at a first location proximate the open end 22 of golf bag 12 and at a second location axially spaced from the first location so that first strap 14 defines a first strap opening 15 sized to accommodate one of the shoulders of a person for carrying golf bag 12. Second strap 16 has a first end 56 thus secured to the golf bag at the second location and has a second end 58 secured at a third location axially spaced from the second location between the second location and closed end 20 to define a second strap opening 17 sized to receive the other shoulder. Accordingly, a person may carry the golf bag by inserting both arms respectively through strap openings 15 and 17 so that the golf bag 12 may be supported by the shoulders and suspended transversely across the back, as is shown in the right hand orientation of FIG. 1. It should be understood, however, that the golf bag could be carried with the club heads projecting to the left, that is, in a left hand orientation opposite that orientation, shown in FIG. 1 with the structure described herein reversed.

Figure 5:
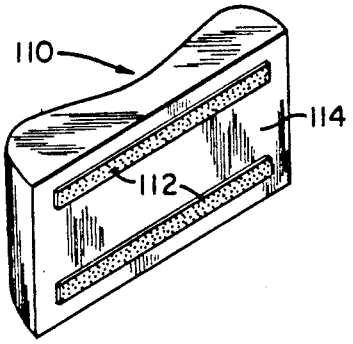
FIG. 5 is a rear perspective view of the back pad according to the present invention used in conjunction with the golf bag of FIG. 2.

To further increase the comfort of carrying golf bag 12, a back cushion or pillow may be provided, if desired, with this pillow being illustrated in FIG. 5. Here, pillow 110 may be constructed of any cushioning material or construction and is preferably concave in shape to conform to the lower back. Pillow 110 includes a pair of mating hook and loop fasteners including strips 112 oriented longitudinally across its back panel 114. Mating velcro strips 116 are longitudinally oriented on the exterior of sidewall 18 of golf bag 12 circumferentially offset from the attachment axis A. Strips 112 are preferably filaform elements while strips 116 are the matching loop elements defining the mated pair. Strips 116 extend from a location approximately midway between the first and second attachment locations of first strap 14 to a location approximately midway between the points of attachment of second strap 16. Pillow 110 is secured to golf bag 12 by the mating action of strips 112 and 116 so that it is centrally positioned on the back of the wearer when golf bag 12 is mounted in the position shown in FIG. 1.

Figure 6:
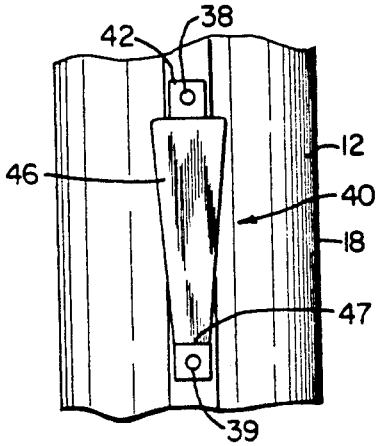
FIG. 6 front plan view of the handle portion of the golf bag shown in FIG. 2.

Handle 40 is best shown in FIG. 6 where it may be seen that handle 40 has opposite handle ends 42 and 44 which are respectively secured to sidewall 18 of golf bag 12 by rivets 43 and 45. Handle 40 has a central portion 46 that is tapered so that it is narrower at the end 47 thereof proximate closed end 20 and is wider at the end 48 thereof proximate open end 22. As described below, this construction helps facilitate the use of first strap 14 independently of second strap 16.

Figures 7A, 7B, 7C, 7D:
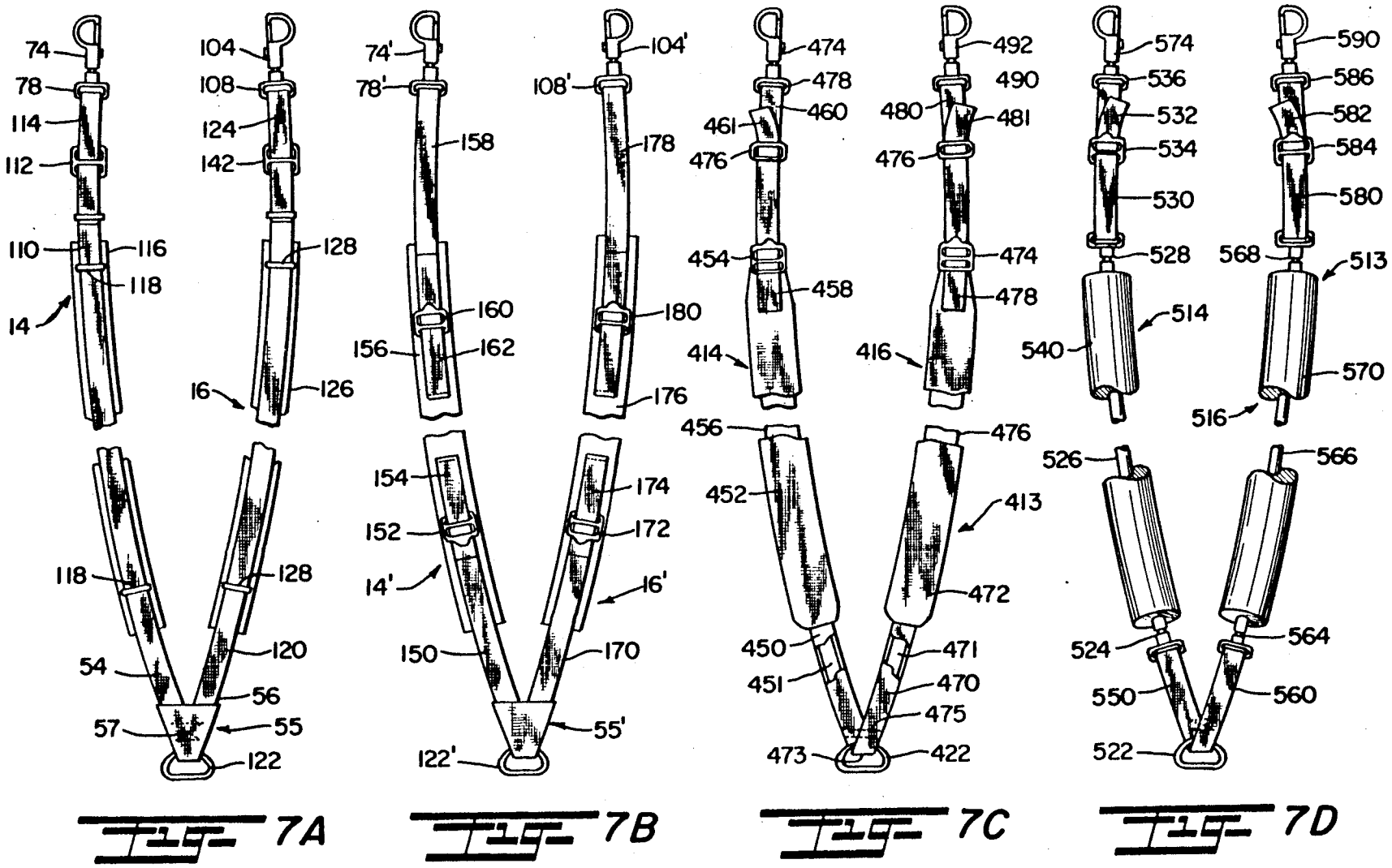
FIGS. 7*a* and 7*b* shown alternate embodiments of the dual strap assembly used with a golf bag according to the present invention.

Turning, therefore, to the assembly of first and second straps 14 and 16, reference may be made first to FIG. 7*a* which shows a first embodiment of this strap assembly 13. Here, it may be seen that first strap 14 is constructed utilizing a primary webbing strip 110 which extends from D-ring 122 at central portion 55 to a terminus at buckle 112; a second webbing strip 114 which extends from buckle 112 to ring 78 which forms part of swivel clip 74. An enlarged elongated cushion or pad 116 is mounted to primary webbing strip 110 by means of a plurality of loops, such as loops 118 to provide additional support and comfort to the persons shoulders. Pad 116 may be constructed in any convenient manner; for example, pad 116 may be a foam filled nylon tube or may be laminated as layers of different foam material, as is readily known in the art. Utilization of primary webbing strip 110 connected to secondary webbing strip 114 by buckle 112 allows for the adjustment of the effective length of first strap 14.

Likewise, second strap 16 includes a primary webbing strip 120 which extends from D-ring 122 to buckle 124. A secondary webbing strip 124 then extends from buckle 124 to ring 108 on swivel clip 104. An enlarged elongated cushion or pad 126 is mounted by means of loops 128 to primary webbing strip 120, again, to increase comfort for the wearer when carrying golf bag 12. This pad 126 is constructed in any manner well known in the art, as described with respect to the pad 116, above. Adjustment is again accomplished by the buckle 124 so as to accommodate different sizes of persons carrying golf bag 12. As is also shown in FIG. 7(*a*), strips 110 and 120 may be a unitary strip folded around D-ring 122 and reinforced by stitching 57 through a webbing strip 59 at central portion 55.

An alternate embodiment of the strap assembly is shown in FIG. 7(*b*). Here, a strap assembly includes a first strap 14' and a second strap 16'. Strap 14' includes a webbing strip 150 which extends from D-ring 122' at central portion 55' to a first adjustment buckle 152 which is secured to an enlarged elongated pad 156 by means of webbing strip 154. Similarly, a secondary webbing strip 158 extends from ring 78' of swivel clip 74' to a second adjustment buckle 160 which in turn is secured to pad 156 by means of webbing strip 162. Likewise, second strap 16' includes a primary webbing strip 170 that extends from D-ring 122' to a third adjustment buckle 172 which is secured to enlarged elongated pad 176 by means of a webbing strip 174. A secondary webbing strip 178 extends from ring 108' of swivel clip 104' to a fourth adjustment buckle 180 secured to pad 176 by means of webbing strip 182. The ends of primary webbing strips 150 and 170 are attached, therefore, to D-ring 122' and a reinforcement strip 55' is folded around these ends and D-ring 122' to further increase the strength of attachment. It may thus be seen from FIG. 7(*b*) that the alternate embodiment shown therein and described above allows for four points of adjustment so that the effective length of straps 14' and 16' may be varied while maintaining their respective pads 156 and 176 in a centralized location. Naturally, other constructions of straps 14, 14', 16 and 16' to provide other means for adjustment are well within the scope of the invention.

Another embodiment of the strap assembly is shown in FIG. 7(*c*). Here, strap assembly 413 includes a first strap 414 and a second strap 416. Strap 414 includes a tubular webbing strip 450 which extends from a D-ring 422 to be secured to a larger tubular webbing strip 452. A first adjustment buckle 454 is secured to an opposite end of tubular webbing strip 452 by means of a secondary webbing strip 458 that is stitched to webbing strip 452. Buckle 454 adjustably receives webbing strip 460 which extends around ring 478 of a swivel clip 474, and ring 476 is provided to retain the tail 461 of webbing strip 460. Enlarged tubular strip 452 mounts therein a pad or cushion 456 which may be of any suitable form or laminate form material. Tubular webbing strip 450 receives a resilient element 451 in the form of a strip of resilient plastic material. Second strap 416 of strap assembly 414 is constructed similarly to first strap 414 and includes a first tubular webbing strip 470 which extends from buckle 422 to webbing strip 472 that receives a cushion or pad 476. At an opposite end, webbing strip 472 is secured by a secondary webbing strip 478 to an adjustment buckle 474 that receives a webbing strip 480 that is reversed upon itself to have a tail 481 secured by buckle 476. Webbing strip 480 mounts to ring 490 of swivel clip 492. Webbing strip 470 receives a plastic resilient element 471. It should be appreciated that, in the construction shown in FIG. 7(*c*) webbing strips 450 and 470 are formed as a unitary strip that is folded upon itself to form a reversed end 473 that receives D-ring 422 with this reversed end being secured around ring 422 by means of stitching 475. The function of stiffener strips 451 and 471 may be now more fully appreciated. When the person utilizing strap assembly 413 first mounts the golf bag on one shoulder using first strap 414, stiffener element 471 acts to partially hold open the second strap opening thereby facilitating insertion of the other arm and shoulder through the second strap opening. Accordingly, rather than merely dangling alongside the golf bag so that mounting of the golf bag on the second shoulder is difficult, second strap 416 will be elevated so that the user may conveniently insert his/her arm through the second opening and thereby hoist the golf bag onto his/her back.

A final embodiment of the strap assembly is shown in FIG. 7(*d*). Here, a first strap 514 has a web strip 550 attached to D-ring 522 and, at an opposite end, to a swivel connector 524. Swivel 524 is connected to a cord 526 so that cord 526 really rotates with respect to connector 524. The opposite end of cord 526 is connected to swivel 528 which is in turn connected to a web strip 530. The web strip 530 is connected to another web strip 532 by means of an adjustable buckle 534, and web strip 532 is connected to swivel 536 of clip 574. A tubular foam piece 540 is mounted over cord 526 between swivel connectors 524 and 528. Accordingly, it may be appreciated that foam roller 540 may freely rotate on the axis defined by swivel connectors 524, 528. Likewise, strap 516 includes a web strip 560, which may be intregal with web 550. Web strip 560 is connected at one end to D-ring 522 and at the other end to a swivel connector 564. Swivel connector 564 is connected to a cord 566 and, the other end to a swivel connector 568. Cord 566 freely rotates with respect to swivels 564 and 568, and a tubular foam piece 570 is mounted on cord 566 for free rotation therewith. Swivel connector 568 is also connected to a web strip 580 that is connected to a web strip 582 by means of an adjustable buckle 584. Web strip 582 terminates at swivel connector 586 and clip 590. From this description, it should be appreciated that mounting strap assembly 513 is easily mounted on the shoulders since, when the arm and shoulder is inserted through a respective strap opening, foam pieces 540 and 570 define rollers that will roll over articles of clothing to prevent binding, snagging and the like.

Figure 8:
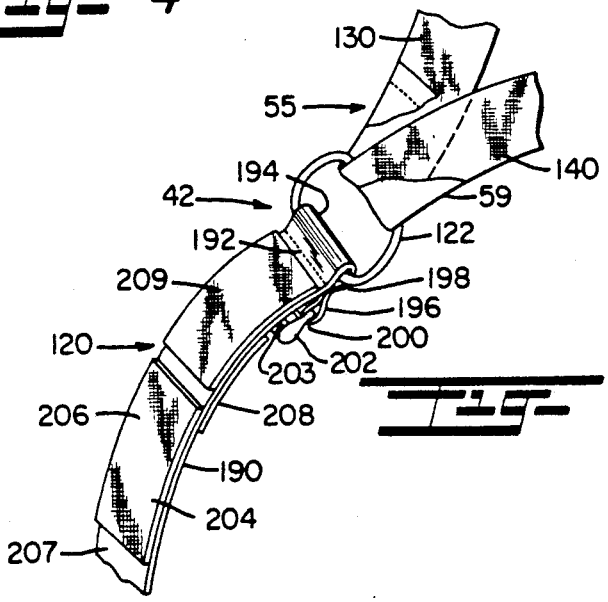
FIG. 8 is a perspective view partially broken away of the central releasable mount used in the present invention.

The attachment of the various strap assemblies, such as shown in FIGS. 7(*a*)–7(*d*), may be accomplished by connecting the central portion 55 thereof to handle 40 by means of the releasable strap assembly 120, best shown in FIG. 8. Here, it may be seen that releasable strap assembly 120 is secured, by way of example, to D-ring 122 by means of a primary webbing strip 190 that is folded about itself and sewn at 192 to create the sleeve 194 that receives D-ring 122. A reversed end 196 is provided at a short end 198 of strip 190 to form a sleeve 200 that mounts a buckle 202. Long end 204 of webbing strip 190 is provided with a first strip 206 of filaform elements adjacent free end 207 thereof. A second strip 208 of filaform elements is mounted on a side of webbing strip 190 opposite filaform strip 206, with filaform strip 208 being located centrally between free end 207 and sleeve 194. A strip of loop elements 209 is mounted on webbing strip 190 on adjacent sleeve 194 and on the same side of strip 190 as filaform strip 206.

With reference, then, to FIG. 3, for example, it may be seen that strap assembly 42 may be utilized to secure D-ring 122 to handle 40. Here, free end 207 is inserted through handle opening 41 so that filaform strip 208 engages loop strip 43 mounted to the underside of handle 40. Free end 207 is then inserted through slot 203 in buckle 202, from the inside out, so that it may be reverse folded about itself and passed again through handle opening 41 where it may then be wrapped around handle 40 to engage loop strip 209 on webbing strip 90. The excess tail, if any, of free end 207 may then be inserted through D-ring 122, if desired.

From the foregoing, it may be seen that the golf bag and strapping assembly according to the present invention may be readily employed to facilitate the transport of a golf bag by means of a person during the game of golf. A strap assembly, such as strap assembly 13, is then secured to handle 40 at D-ring 122 in the manner described above and swivel clips 74 and 104 are respectively attached to D-rings 70 and 100 so that, for the desired orientation of golf bag 12, pads 136 and 146 will rest against the shoulders. The distance between first strap first end 52 and first strap second end 54 is selected by the point of attachment of strap assembly 42 to handle 40 to accommodate the width of the shoulders, and the effective lengths of straps 14 and 16 are adjusted for the length of the person's torso, as desired for comfort. The distance between second strap first end 56 and second strap second end 58 is automatically adjusted since the position of circumferential mounting strap 80 may be adjusted in location by means of slide bracket 84 sliding on band 82. It may be further seen that circumferential positioning is automatically accommodated by the slippage of D-rings 70 and 100 circumferentially around their respective mounting straps 60 and 80.

It may be seen that handle 40 also provides a convenient "one-handed" lift for golf bag 12 when the golf bag is not worn on the shoulders. Further, for carrying golf bag 12 a short distance, it is sometimes desirable that a single carrying strap be used. To this end, first strap 14 is the upper primary carrying strap that may be placed over one of the shoulders and strap 16 is left in a dangling state. It may now be appreciated that the tapered construction of handle 40 shown in FIG. 6, helps prevent any slippage of releasable strap assembly 42 longitudinally of central portion 46 of handle 40. That is, once releasable strap assembly 13 is mounted on handle 40, the increasing width of central portion 46 and the resistance of releasable strap assembly 120 to any increase in size once it is wrapped around handle 40 and secured prevents upward longituding slippage.

From the foregoing, it may also be readily appreciated that different attachment structures can be provided for mounting straps 14 and 16 and that strap assembly 13 can be provided with other mounting strap constructions, as would now be recognized by the ordinarily skilled person in this field of endeavor. Two such embodiments are shown respectively in FIGS. 9–10 and FIG. 11. Further, FIG. 12 shows a mounting strap assembly that may be used as a convenient retro-fit on a wide variety of existing golf bags. The essential feature of the present invention, therefore, should be understood to be the inclusion of a pair of shoulder straps on golf bag with these shoulder straps being sized to accommodate both shoulders of the wearer and being connected so that they each extend longitudinally of the golf bag in end to end relation.

Figure 9:
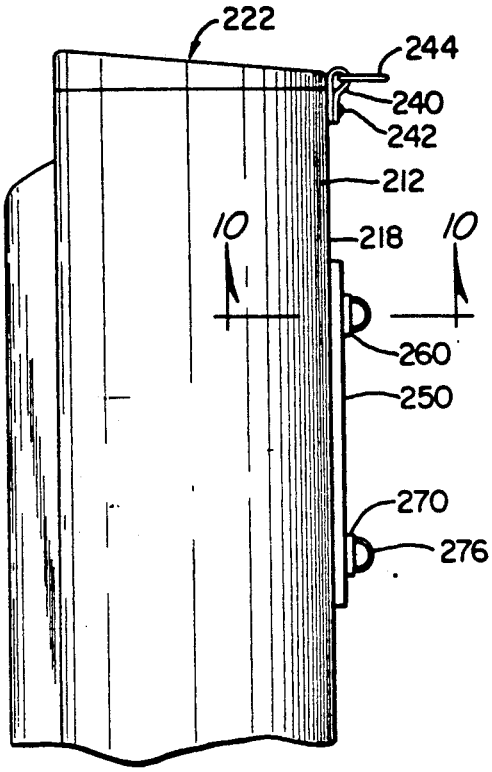
FIG. 9 is a side view in elevation of an alternate embodiment of the central and lower mounts according to the present invention for use with the golf bag.
Figure 10:
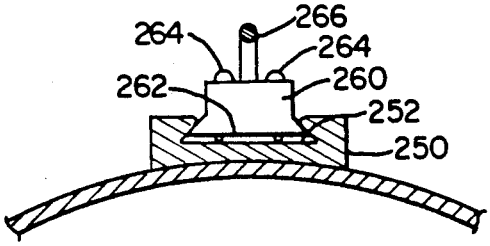
FIG. 10 is a cross-sectional view taken about lines 10—10 of FIG. 9.

Turning, therefore, to FIGS. 9 and 10, it may be seen that mounting straps 60 and 80 have been eliminated as has handle 40. Instead, a first attachment structure is provided for a golf bag 212 in the form of a loop 240 riveted by rivet 242 proximate open end 222 of golf bag 212. Loop 240 mounts a metal ring 244 that provides point of attachment, for example, for a swivel clip such as clip 74. An elongated channel piece 250 is mounted longitudinally of sidewall 218 of golf bag 212 and is provided with a pair of slide elements 260 and 270 which may be adjustably positioned therein. To this end, as is seen in FIG. 10, channel piece 250 has a dove tail channel 252 formed therein and each channel piece, such as channel piece 260, includes a flared base 262 which is sized for matable sliding engagement with channel 252. A pair of locking screws 264 is provided to lock slide element 260 in position at a selected location so that an arcuate ring element 266 is positioned at a desired attachment point. The structure of slide element 270 is similar and is not shown in detail other than that it may be appreciated that ring element 276 may likewise be positioned at a desired third location for attachment of the mounting strip assembly. Accordingly, ring 276 defines a third location for attachment adapted to receive, for example, swivel clip 104. In this embodiment, then, the strap assembly is modified to eliminate, for example, D-ring 122 and releasable strap assembly 120 with this structure simply being replaced by another swivel clip such as either clips 74, 104.

Figure 11:
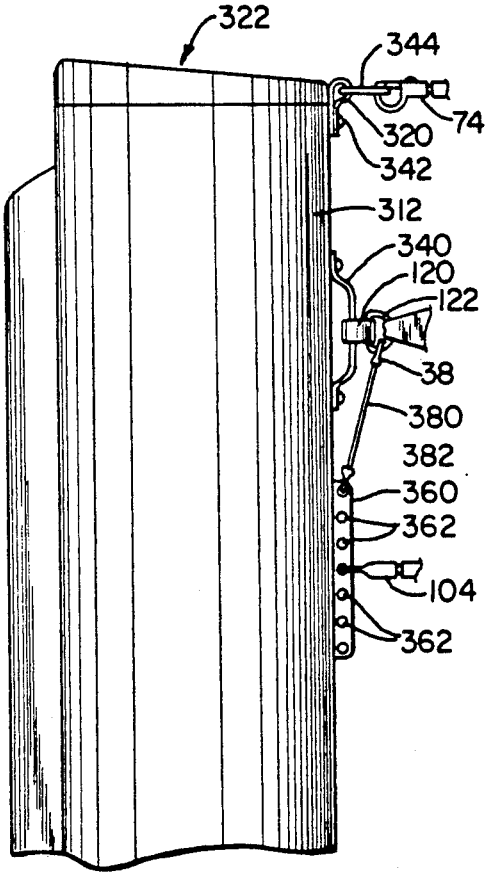
FIG. 11 is a side view in elevation of a top portion of the golf bag according to the present invention showing yet another alternate strap mounting structure.
Figure 12:
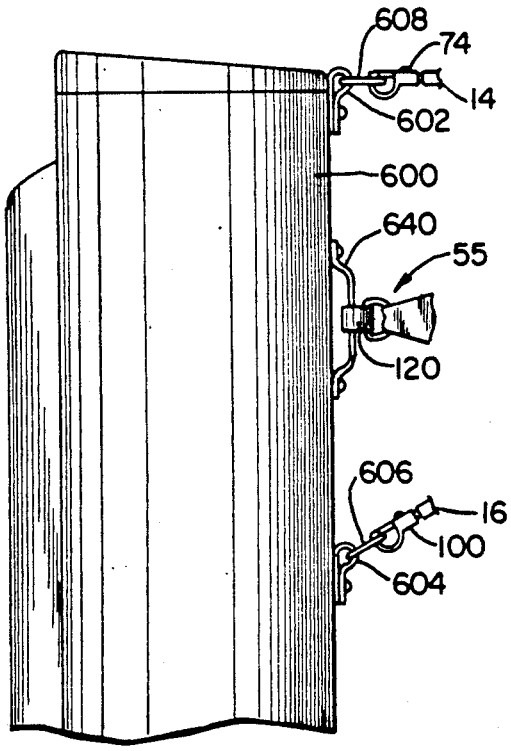
FIG. 12 is a perspective view of the strap assembly of the present invention constructed as a retrofit apparatus for standard golf bags.

A third exemplary embodiment is shown in FIG. 11. Here, modification to the bag assembly shown in FIGS. 2–8 is accomplished by eliminating mounting strap 60 and replacing it with a web loop 320 mounted by rivet 342 proximate open end 322 of golf bag 312. Web loop 320 mounts a metallic ring 344 to which a swivel clip 74 may be attached. A handle 340 is provided on bag 312 and is longitudinally or axially spaced from the web loop 320. A third point of attachment is formed by a longitudinal rib 360 provided with a plurality of openings 362 formed therein. Accordingly, swivel clip 104 may be clipped onto rib 360 by means of any selected hole 362, thereby providing selected incremental adjustment of the distance between clip 104 and the point of attachment of mounting strap assembly 42. In the embodiment shown in FIG. 11, however, handle 340 does not have the tapered construction of handle 40 shown in FIG. 6. Accordingly, in order to prevent upward sliding movement of mounting strap assembly 42, a cord 380 is provided and is secured at one end 382 to D-ring 122 and, at its other end to a clip 382 which may be clipped into any of the selected mounting holes 362. Thus, the length of cord 380 limits to a minimum the distance between first attachment point 320 and the second attachment point defined by mounting strap assembly 120. The distance between mounting strap assembly 120 and the third attachment point is then selected by the location at which swivel 104 is attached to rib 360.

The use of the present strap assembly, such as, shown in the embodiments described with respect to FIGS. 7(*a*)–(*d*) may be employed with a standard construction golf bag, as is shown in FIG. 12. Here, a standard golf bag 600 has an upper connector 602 and a lower connector 604 which typically is attached to a buckle element 606. Connector 602 includes a metallic ring 608 of conventional construction. A single belt which mates with buckle 606 and which includes a clip which attaches to ring 608 is normally provided as a single carrying strap. In the embodiment shown in FIG. 12, however, it may be seen that this strap is removed and that a strap assembly according to the present invention is employed. Here, for example, swivel clip 74 of first strap 14 is attached directly to metallic ring 608 while central portion 55 is attached to the handle 640 by means of mounting strap assembly 120. The free end of second strap 16 is connected by means of swivel clip 100 directly to buckle 606. Thus, it may be seen that the strap assembly described with respect to the exemplary embodiments of this invention may conveniently be used on existing golf bags and thus provides an inexpensive retro-fit system employing the concepts described herein.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. In a golf bag to be carried by a person, said golf bag having an elongated enclosure including a surrounding sidewall, a closed end and an open end whereby golf clubs may be inserted lengthwise into said golf bag through the open end, the improvement comprising:

a shoulder strap assembly disposed externally of said sidewall including first and second strap members, each of said strap members having opposite ends;

first and second securing means for securing each of said opposite ends of said first strap member to axially spaced locations on said sidewall including a first location proximate said open end and a second location axially spaced from said first location whereby said first strap member defines a first strap opening through which one arm of the person can be inserted and first securing means including a first mounting member extending circumferentially around at least a portion of said enclosure proximate said open end for a circumferentially adjustable connection of said first securing means to said sidewall; and third and fourth securing means for securing each of said opposite ends of said second strap member to axially spaced locations on said sidewall whereby to define a second strap opening so located with respect to said first strap opening that another arm of the person can be inserted through said second strap opening and said golf bag supported on both shoulders of the person carrying said golf bag.

2. The improvement according to claim 1, wherein said second securing means and said third securing means are fastened together to define a central strap portion secured to said golf bag at said second location.

3. The improvement according to claim 2 including releasable mounting means on said central portion for securing said central portion to said golf bag.

4. The improvement according to claim 3 wherein said golf bag has a handle portion located on said sidewall extending axially therealong and wherein said releasable mounting means includes webbing strap means to encircle and attach said releasable mounting means to said handle portion.

5. The improvement according to claim 4 wherein said webbing strap means includes a mounting web attached to said handle portion, and a first buckle element at one end of said mounting web attached to said central portion.

6. The improvement according to claim 5 wherein said mounting web includes mating hook and loop fasteners to secure said mounting web to itself.

7. In a golf bag according to claim 1, said third securing means securing one end of said second strap member to a location proximate to said second location, and said fourth securing means securing the other of said opposite ends of said second strap member to a third location spaced below said third securing means on said sidewall.

8. The improvement according to claim 7 wherein said central strap portion includes means for holding said second strap member in an elevated condition when said one arm is inserted through the first strap opening and said first strap member extends across said one shoulder with said golf bag suspended by said first strap member so that the second strap opening is thereby oriented to facilitate insertion of said another arm therethrough.

9. The improvement according to claim 8 wherein said means for holding includes a first flexible strap element and a second flexible strap element at said second location.

10. the improvement according to claim 8 wherein said handle portion includes one of a pair of mating hook and loop fasteners and said mounting web includes another of said pair of mating hook and loop fasteners such that said pair engage one another when said mounting web encircles said handle portion.

11. The improvement according to claim 8 including means for adjusting the effective length of said first strap member and means for adjusting the effective length of said second strap member.

12. The improvement according to claim 8 wherein said first and second strap each includes pad means positioned thereon for cushioning support of said golf bag when said first and second straps extend across the shoulders of said person.

13. The improvement according to claim 8 including a pillow element mounted on said sidewall and circumferentially offset from the first, second and third locations and oriented to be positioned against said person along the back when said golf bag is carried.

14. The improvement according to claim 13 wherein said pillow element is releasably secured to said golf bag.

15. In a golf bag according to claim 7, said fourth securing means includes a second mounting member extending circumferentially around at least a portion of said enclosure at said third location, and slidable mounting means slidably connecting each of said first and second strap members to a respective one of said first and second mounting members whereby said first and second strap members are slidable circumferentially along said first and second mounting members.

16. In a golf bag according to claim 15, each of said first and second mounting members including means adjustably attaching opposite ends of said mounting members to said sidewall whereby to adjust the axial spacing between said first and fourth locations and said second and third locations.

17. In a golf bag according to claim 1, said first and fourth securing means including releasable means for releasably securing said first and second strap members to said first location and said third location on said sidewall.

18. In a golf bag according to claim 17, wherein said releasable means each includes a swivel clip.

19. In a golf bag to be carried by a person, said golf bag having an elongated enclosure including a surrounding sidewall, a closed end and an open end whereby golf clubs may be inserted lengthwise into said golf bag through the open end, the improvement comprising:

a strap assembly disposed externally of said sidewall including first and second strap members, each of said strap members having opposite ends;

a handle attached to said sidewall;

first and second securing means for securing each of said opposite ends of said first strap member to axially spaced locations on said sidewall including a first location proximate said open end and a second location proximate said handle whereby said first strap member defines a first strap opening through which one arm of the person can be inserted said first securing means including a first mounting strip extending circumferentially around at least a portion of said tubular body proximate said open end and a first slide ring slidably received on said first mounting strip, said first mounting ring movable along said first mounting strip to circumferentially spaced locations; and third and fourth securing means for securing each of said opposite ends of said second strap member to axially spaced locations on said sidewall whereby to define a second strap opening so located with respect to said first strap opening that another arm of the person can be inserted through said second strap opening whereby said golf bag can be selectively carried across one shoulder with only said first strap member with said golf bag inclining downwardly away from the one shoulder across the back and said golf bag may be selectively carried with both shoulders by inserting both arms through said first and second strap openings so that said golf bag is oriented transversely across the back of the person carrying said golf bag.

20. In a golf bag according to claim 19 including a concave pillow element mounted on said sidewall and circumferentially offset from said handle approximately ninety degrees whereby said pillow element is located between said golf bag and the back of the person.

21. In a golf bag according to claim 19 including first and second auxiliary compartments located on and mounted to said sidewall, a first auxiliary compartment circumferentially offset from said handle approximately ninety degrees and positioned opposite the back, said first auxiliary compartment being elongated and extending substantially from said closed end to said open end, and said second auxiliary compartment located proximate said closed end and diametrically opposite said first compartment, said first and second auxiliary compartments sized to receive auxiliary golfing equipment whereby said golf bag may be thereby balanced when the set of golf clubs is supported on one or both shoulders.

22. In a golf bag according to claim 19 including a wedge-shaped element mounted in said tubular body proximate said open end and diametrically offset from the attachment axis whereby said golf clubs are elevated at portions thereof adjacent said open end when said golf bag is in the fully supported state thereby to resist inadvertent dislodgment of the golf clubs from said tubular body during use.

23. In a golf bag according to claim 19 wherein said handle is oriented axially of said sidewall, said second and third securing means including a common strap assembly mounted on said handle and fastened thereto.

24. In a golf bag according to claim 19 wherein said fourth securing means includes a second mounting strip extending circumferentially around at least a portion of said tubular body adjacent the third location on either side of the attachement axis and a second slide ring slidably received on said second mounting strip, said second slide ring movable along said second mounting strip to locations circumferentially on either side of the attachment axis.

25. In a golf bag according to claim 24 wherein said second mounting strip is movable longitudinally of said enclosure.

26. In a golf bag according to claim 19 wherein said second mounting strip extends completely around said enclosure and is operative to cradle said enclosure when said golf bag is in the fully supported state and wherein said second mounting strip includes limit means for limiting the circumferential travel of said second slide ring.

27. In a golf bag according to claim 19 wherein said first and second strap members include means for adjusting the effective length thereof whereby the first and second strap openings are adjustable in size.

28. In a golf bag according to claim 19 wherein said second strap member crosses in front of said first strap member when said golf bag is in the fully supported state.

29. In a golf bag according to claim 19 wherein said first strap member includes a first flexible element and said second strap member includes a second flexible element, said first and second flexible elements operative to hold partially open the first and second strap openings, respectively.

30. In a golf bag according to claim 29 wherein said first and second flexible elements are defined by a unitary strip, said mounting means includes a ring element, and said first and second flexible elements are secured to one another proximate said ring.

31. In a golf bag according to claim 19, said second securing means adjustably securing said first strap member to said golf bag at a longitudinally adjustable second location.

32. In a golf bag according to claim 19 wherein said third securing means adjustably secures said second strap member to said golf bag at a longitudinally adjustable third location.

* * * * *